US008844798B2

(12) United States Patent
Linkel

(10) Patent No.: US 8,844,798 B2
(45) Date of Patent: Sep. 30, 2014

(54) DUAL RECLOSABLE DISPENSER CARTON

(75) Inventor: Stephan M. Linkel, Ewing, NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 394 days.

(21) Appl. No.: 13/307,576

(22) Filed: Nov. 30, 2011

(65) Prior Publication Data

US 2013/0134211 A1 May 30, 2013

(51) Int. Cl.
*B65D 5/66* (2006.01)

(52) U.S. Cl.
USPC ..... 229/121; 229/230; 229/160.1

(58) Field of Classification Search
USPC ..... 229/121, 160.1, 122.1, 122, 230, 229, 229/231; 206/427, 775; 221/302, 305
See application file for complete search history.

(56) References Cited

U.S. PATENT DOCUMENTS

| | | | | |
|---|---|---|---|---|
| 2,088,171 | A | 8/1935 | Kaufman | |
| 2,213,525 | A | 9/1940 | LaFlamme | |
| 2,886,232 | A | 5/1959 | Leone | |
| 3,300,115 | A * | 1/1967 | Schauer | 221/305 |
| 3,346,167 | A * | 10/1967 | Schmidt | 229/117.15 |
| 3,347,446 | A * | 10/1967 | Guyer et al. | 229/120.18 |
| 3,432,090 | A | 3/1969 | Engel | |
| 3,568,911 | A | 3/1971 | Bebout | |
| 3,593,908 | A | 7/1971 | Desmond | |
| 3,684,158 | A | 8/1972 | Harris | |
| 4,283,000 | A | 8/1981 | White | |
| 4,314,643 | A | 2/1982 | Forbes, Jr. | |
| 4,396,143 | A * | 8/1983 | Killy | 221/305 |
| 4,530,548 | A * | 7/1985 | Spamer et al. | 312/45 |
| 4,602,735 | A | 7/1986 | Aaron | |
| 5,143,210 | A | 9/1992 | Warwick et al. | |
| 5,368,194 | A * | 11/1994 | Oliff et al. | 221/305 |
| 5,385,234 | A * | 1/1995 | Stout et al. | 206/427 |
| 5,505,372 | A * | 4/1996 | Edson et al. | 229/121 |
| 5,511,722 | A | 4/1996 | Dixon | |
| 5,746,369 | A | 5/1998 | McDermott | |
| 5,813,597 | A * | 9/1998 | Wakevainen | 229/122.1 |
| 6,866,188 | B2 | 3/2005 | Harrelson | |
| 6,951,300 | B2 | 10/2005 | Caille et al. | |

(Continued)

FOREIGN PATENT DOCUMENTS

| | | | |
|---|---|---|---|
| DE | 8634947 | U | 7/1987 |
| DE | 8809938 | U | 9/1988 |
| DE | 19619275 | A | 11/1997 |
| WO | WO 2009/128748 | A | 10/2009 |

OTHER PUBLICATIONS

Paperboard Packaging Council, Ideas and Innovations, second edition, Section 2, Carton Category Style Characteristics, Tube Style Carton Design Variations End Closure Options (1.628) and Specialty Packaging Counter Display Shippers and Dispensers (4.206) (2004).

*Primary Examiner* — Justin Larson
*Assistant Examiner* — Phillip Schmidt

(57) ABSTRACT

A dispenser carton having more than one dispenser opening, permitting two different modes of access to products or articles contained within the carton. Preferably, the dispenser openings are oriented to permit the optimal orientation of products for dispensing from each of the dispenser openings. In accordance with another aspect of the present invention, separate and independent from the first aspect yet complementary thereto if desired, the dispenser openings are provided to permit loading of articles therein in an oriented manner corresponding to automated carton-loading equipment and optionally also to permit dispensing through at least one of the openings in a desired dispensing orientation.

9 Claims, 6 Drawing Sheets

(56) References Cited

U.S. PATENT DOCUMENTS

| | | | | |
|---|---|---|---|---|
| 6,974,072 | B2 | 12/2005 | Harrelson | |
| 7,066,380 | B2 | 6/2006 | Blake | |
| 7,134,593 | B2 | 11/2006 | Harrelson | |
| 7,204,406 | B2 | 4/2007 | Bone | |
| 7,475,777 | B2 | 1/2009 | Fung et al. | |
| 7,648,048 | B2 * | 1/2010 | Smith | 221/305 |
| 7,703,665 | B2 | 4/2010 | McGowan | |
| 7,766,219 | B2 * | 8/2010 | Gomes et al. | 229/122 |
| 2002/0109004 | A1 | 8/2002 | Barr et al. | |
| 2005/0006447 | A1 | 1/2005 | Caroli | |
| 2006/0016864 | A1 | 1/2006 | Harrelson | |
| 2006/0027639 | A1 | 2/2006 | Rasmussen | |
| 2006/0289616 | A1 | 12/2006 | McGowan | |
| 2008/0078823 | A1 | 4/2008 | Pezzoli | |
| 2009/0090739 | A1 | 4/2009 | Merl | |
| 2009/0145954 | A1 | 6/2009 | Ho Fung et al. | |
| 2009/0272756 | A1 | 11/2009 | Hackney | |
| 2010/0044421 | A1 | 2/2010 | Learn | |
| 2010/0051494 | A1 | 3/2010 | DeBusk et al. | |
| 2010/0108749 | A1 | 5/2010 | House | |

* cited by examiner

300

DUAL RECLOSABLE DISPENSER CARTON

FIELD OF THE INVENTION

The present invention relates to a carton for holding and/or dispensing a plurality of individual articles. More particularly, the present invention relates to a carton that has two independent reclosable dispenser openings, each opening preferably being configured to provide access to, and optionally also to dispense, products within the carton.

BACKGROUND OF THE INVENTION

Boxes or cartons designed to facilitate dispensing of individual products or articles contained therein are known in the art. One example of a dispenser carton (such term being used herein for the sake of convenience without intent to limit) is described in U.S. Pat. No. 3,593,908 to Desmonds, entitled "Dispenser Bin Carton." The described dispenser bin carton has a movable bin front portion that is hingeably movable with respect to the front panel of the carton between a closed position (in which the carton is closed) and a bin delivery position (in which the bin front panel is pivoted away from the front panel to permit access to the contents of the carton). Only one dispenser opening, the bin front portion, is provided.

Dispenser cartons having more than one type of dispenser opening are also known. One example of a dispenser carton having two different dispenser openings is described in U.S. Pat. No. 6,951,300 to Caille et al., entitled "Display Packaging." The described packaging has a dispenser drawer similar to the bin front portion of the above-described patent to Desmonds. In addition, the packaging described in the Caille patent also has a removable section that may be removed to permit access to the contents of the packaging.

It will be appreciated that it may be preferable to load or to display certain articles or products (hereinafter "articles" for the sake of convenience, without intent to limit) in dispenser cartons in a predetermined, set orientation. For instance, elongated articles (e.g., lip balms, writing instruments, rolls of hard candy or other stackable individual comestibles, tampons, etc.) preferably are dispensed in a given orientation with respect to the dispenser opening. The known prior art dispenser cartons do not provide more than one dispenser opening permitting the articles therein to be dispensed through each of the multiple dispenser openings in a particular desired orientation.

Moreover, it will be appreciated that carton loading equipment, used to load products into a carton in an automated manner, may require the products to be oriented by the automated carton loading equipment in a predetermined, set orientation. The known prior art dispenser cartons thus present an added complication if the automated carton loading equipment must load the products in an orientation that does not correspond to or conform to the orientation desired for the products when dispensed through the one or more dispenser openings.

It therefore would be desirable to provide a dispenser carton with more than one dispenser opening, the openings being positioned along the carton to permit the desired orientation of products for loading the articles in a desired orientation and/or for dispensing the articles in a desired orientation through the dispenser opening.

SUMMARY OF THE INVENTION

In accordance with principles of the present invention, a dispenser carton is provided with more than one different type of reclosable dispenser opening (hereinafter, reference to "reclosable" will not be repeated, it being understood that the dispenser openings of the present invention are intended to be reclosable). In accordance with one aspect of the present invention, the dispenser openings are oriented to permit the optimal orientation of products for dispensing from each of the dispenser openings. In an exemplary embodiment, a dispenser carton has a bin or door type dispenser along one wall and a flip-top lid type dispenser along another wall. The dispenser door pivots to move with respect to the carton to permit access to the products dispensed within the door, and the flip-top lid pivots to move with respect to the carton to open at least an upwardly facing wall of the carton. The articles within the dispenser carton are elongated and are all oriented in the same direction. The dispensers are arranged along the dispenser carton so that the articles are dispensed through the dispensers in the optimal dispensing orientation.

In accordance with another aspect of the present invention, separate and independent from the first aspect yet complementary thereto if desired, a dispenser carton is formed with at least two dispenser openings, the dispenser openings permitting loading of articles therein in an oriented manner corresponding to automated carton-loading equipment and also permitting dispensing through at least one of the openings in a desired dispensing orientation. In an exemplary embodiment, the dispenser openings of the dispenser carton of such embodiment are oriented to permit loading elongated products into the dispenser carton along a longitudinal axis of the products. In addition, at least one of the dispenser openings is oriented so that the elongated products are oriented in a predetermined desired orientation for optimal dispensing therefrom.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
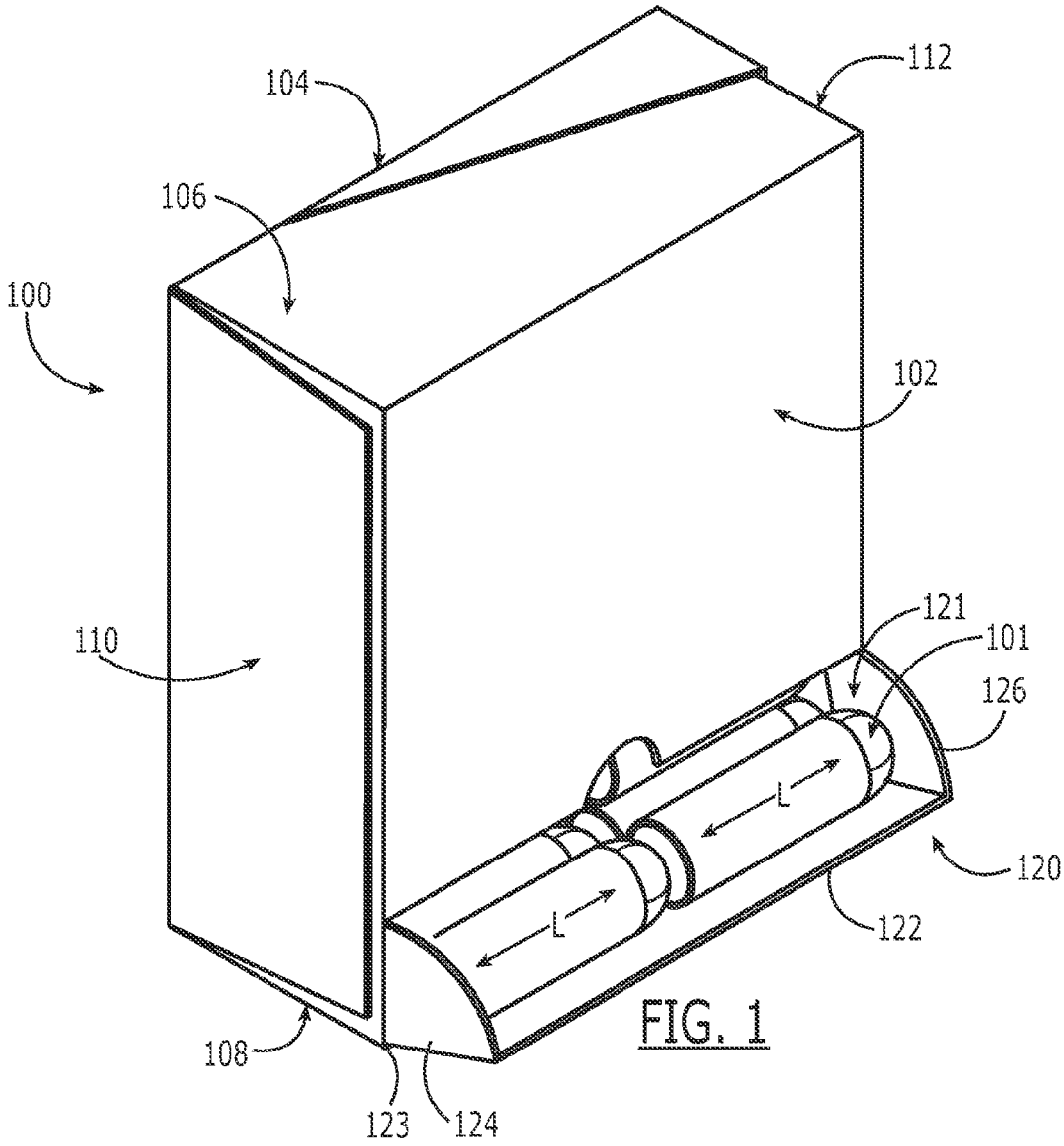
FIG. 1 is a perspective view of an exemplary dispenser carton formed in accordance with principles of the present invention with a first of a plurality of dispenser openings being shown in an open position.

An exemplary dispenser carton 100 formed in accordance with principles of the present invention is illustrated in FIGS.

1 and 2. In accordance with principles of the present invention, exemplary carton 100 is formed with more than one dispenser opening through which articles within the carton may be dispensed. In particular, as may be appreciated upon comparing FIG. 1 and FIG. 2, dispensers 120 and 130 are oriented along dispenser carton 100 such that elongated articles 101 contained within carton 100 in a uniform orientation are positioned for optimal accessing and dispensing through dispenser openings 121, 131 formed by dispensers 120, 130, respectively. Although a dispenser carton formed in accordance with principles of the present invention may have any number of walls, the exemplary embodiment illustrated in FIGS. 1 and 2 is a six-sided carton with major walls 102, 104 (along which at least one of the dispenser openings is formed, and which typically, though not necessarily, is one of if not the largest walls of the carton), side walls 106, 108 (extending between major walls 102, 104), and end walls 110, 112 (extending between major walls 102, 104 and side walls 106, 108, and optionally through at least one of which articles are loaded into carton 100).

As shown in FIG. 1, exemplary dispenser carton 100 has a first dispenser in the form of a dispenser door 120 (also know by other terms, such as dispenser bin or drawer, the term "dispenser door" being used for the sake of convenience without intent to limit) preferably formed along one of major walls 102, 104 (in the exemplary embodiment of FIG. 1, along major wall 102). Dispenser door 120 is pivotable about a pivot axis or hinge 123 between a closed position (in which dispenser door front wall 122 is substantially coplanar with the carton wall along which it is provided—in the exemplary embodiment of FIG. 1, major wall 102—and articles 101 are not accessible) and an open position (in which dispenser door 120 is pivoted away from carton 100 to permit access, through dispenser opening 121, to articles 101 within carton 100, as illustrated in FIG. 1). Dispenser door 120 has a front wall 122, a left side wall 124, and a right side wall 126 forming a drawer or bin (hereinafter "bin" for the sake of convenience, without intent to limit) in which articles 101 may be retained for dispensing through opening 121 created upon moving front wall 122 away from major wall 102 of carton 100. Preferably, as will become more apparent with reference to exemplary blanks from which carton 100 may be formed, side walls 124 and 126 may be formed to inhibit excess movement with respect to carton 100 so that the range of motion of front wall 122 is somewhat limited so that articles 101 are sufficiently retained within the bin formed by dispenser door 120.

Figure 2:
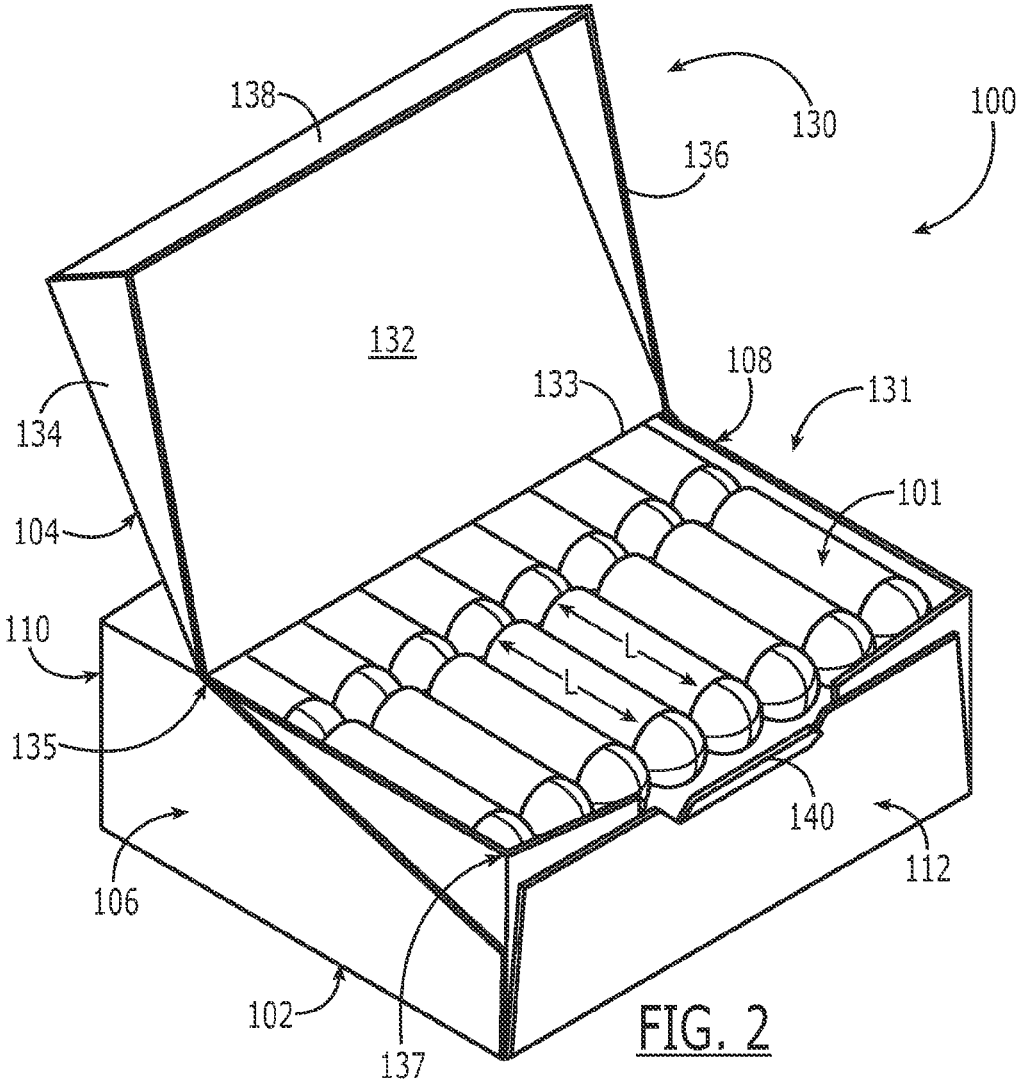
FIG. 2 is a perspective view of the exemplary dispenser carton of FIG. 1 with a second of a plurality of dispenser openings being shown in an open position.

Exemplary dispenser carton 100 of FIGS. 1 and 2 has a second dispenser in the form of a lid dispenser 130. In the exemplary embodiment of FIGS. 1 and 2, lid dispenser 130 is formed along the one of major walls 102, 104 opposite the major wall 102, 104 in which dispenser door 120 is formed (in the exemplary embodiment of FIG. 2, along major wall 104). Lid dispenser 130 is shown in the exemplary embodiment of FIG. 2 as a hinged lid or flip-top lid which preferably remains coupled to the major wall along which it is formed to be pivotable about hinge 133 between a closed position in which top wall 132 of lid dispenser 130 is substantially coplanar with the carton wall along which it is provided (in this case, major wall 104), and an open position (illustrated in FIG. 2) in which lid dispenser 130 is pivoted away from carton 100 to permit access to articles 101 within carton 100 through access opening 131. However, it will be appreciated that lid dispenser 130 may, instead, be fully separable from carton 100 and returnable to carton 100 to close opening 131 (formed upon moving lid dispenser 130 away from carton 100) to enclose articles 101 within carton 100 as desired. Lid dispenser 130 has a top wall 132, a left side wall 134, a right side wall 136, and a front wall 138 which, in the closed configuration, substantially correspond to (such as by aligning with) major wall 104, side wall 106, side wall 108, and end wall 112, respectively.

If desired, lid dispenser 130 may be formed with a locking or securing feature to secured lid dispenser 130 in a closed configuration. For example, lid dispenser 130 may be a click-lock type lid with a receiving groove or recess on the underside of one of side walls 134, 136, 138 thereof (preferably on front wall 138, as will be appreciated with reference to the discussion, below, of exemplary blanks from which carton 100 may be formed) configured to engage a tab or other protrusion 140 on corresponding carton wall 106, 108, 112 (preferably end wall 112, corresponding to front wall 138 of lid dispenser 130). It will be appreciated that a reverse configuration (in which protrusion 140 is formed on a side wall of lid dispenser 130 and a receiving recess is formed on a corresponding side wall of carton 100) is within the scope of the present invention as well. Upon closure of lid dispenser 130, protrusion 140 engages within the corresponding recess to interlock lid dispenser 130 with a side wall of carton 100 to maintain lid dispenser 130 in a closed configuration.

It is generally desirable for elongated articles to be oriented in a particular direction for optimal accessing and dispensing from carton 100. Accordingly, in accordance with principles of the present invention, the at least two dispenser openings 121, 131 of exemplary carton 100 are preferably configured and oriented such that exemplary articles 101, which are elongated in the exemplary embodiment of FIGS. 1-7, are oriented for optimal accessing and dispensing therefrom. The optimal orientation of elongated articles 101 generally depends on the type of dispensing opening from which articles 101 are to be dispensed.

Elongated articles 101 are preferably dispensed through a bin type dispenser opening (such as formed by exemplary dispenser door 120) in a sideways orientation with the longitudinal axes L of articles 101 substantially parallel to front wall 122 of dispenser door 120. Such configuration allows for feeding of articles 101 from storage within carton 100 downwardly into the bin formed by dispenser door 120 in a more orderly manner than achievable by other orientations of articles 101. If articles 101 have a generally circular cross-section, articles 101 may roll downwardly into the bin formed by dispenser door 120 in their initial orientation. It will be appreciated that dispenser door 120 may be dimensioned to hold one or more columns (in the exemplary embodiment of FIG. 1, two columns) of articles 101.

The optimal orientation of elongated articles for dispensing through a lid positioned at the top of a dispensing carton 100 preferably is a vertical orientation with longitudinal axis L of articles 101 extending from rearwardly-facing end 135 of dispenser opening 131 to forwardly-facing end 137 of dispenser opening 131. It is generally considered easier to remove an elongated article such as article 101 from its free end rather than from its side (particularly if the sides are rounded, wherein attempting to remove an article via contacting its side wall may result in rolling or rotating the article without successfully lifting the article). It is further generally considered typical for a user to access an article dispensed through a dispensing opening (such as an upwardly facing dispensing opening like dispensing opening 131) by moving her finger in a rearward to forward movement (i.e., from rearwardly-facing end 135 toward forwardly-facing end 137). Accordingly, the optimal orientation of exemplary articles 101 for dispensing through exemplary dispensing opening 131 formed by lid dispenser 130 is as illustrated in FIG. 2, namely, a vertical orientation, allowing ready access to an end of article 101 when the user's finger is moved from rearwardly-facing end 135 toward forwardly-facing end 137.

As will be appreciated with reference to FIGS. 1 and 2, dispensers 120 and 130 of exemplary dispenser carton 100 are configured and oriented for optimal dispensing of articles 101 therefrom. Specifically, articles 101 are dispensed through exemplary dispenser 120, in the form of a dispenser door, in their optimal sideways orientation, whereas article 101 are dispensed through exemplary lid dispenser 130, in the form of a flip-top lid, in their optimal vertical orientation. One manner of achieving the desired orientation of dispensers 120, 130 to permit optimal orientation of articles 101 for dispensing through either dispenser, as may be appreciated upon comparison of FIGS. 1 and 2, is to form dispenser door 120 to open about hinge 123 substantially parallel to a side wall of lid dispenser 130 (longitudinal axes L of articles 101 being aligned substantially parallel to side walls 134 and 136 of lid dispenser 130). Longitudinal axes L of articles 101 are substantially perpendicular to end walls 110, 112 of carton 100 (and thus substantially perpendicular to hinge 133 of lid dispenser 130) for optimal orientation for dispensing through dispenser opening 121. With hinge 133 of lid dispenser 130 substantially perpendicular to side walls 134, 136, articles 101 are substantially perpendicular to hinge 133 and thus oriented for vertical dispensing through dispenser opening 131.

In accordance with an additional aspect of the present invention, which optionally may be applied in conjunction with the above-described aspect of the present invention, a carton with at least two dispensers may be formed so that the articles may be oriented for loading in the carton in the optimal orientation for automated packaging or article-loading equipment and preferably also the optimal orientation of the articles within the dispenser carton (such as for optimal orientation for being dispensed through the dispenser openings). It will be appreciated that automated packaging equipment may be somewhat limited in its configuration. For instance, the article loading equipment of automated packaging equipment may be limited in how it may be oriented with respect to the packaging in which the article-loading equipment is to load articles. More particularly, article-loading equipment for loading articles typically does not afford many options for orientation of the articles with respect to the packaging into which the articles are being loaded.

In accordance with this additional aspect of the present invention, dispenser carton 100 has at least two dispenser openings and is configured for loading of articles 101 therein without articles 101 interfering with the dispenser openings and preferably with articles 101 positioned in a desired orientation within dispenser carton 100. In a preferred embodiment in accordance with this aspect of the present invention, articles 101 are positioned within dispenser carton 100 so that articles 101 are oriented with respect to at least one of two dispenser openings in dispenser carton 100 in an optimal orientation for being dispensed through the at least one of the two dispenser openings. As may be appreciated with reference to the exemplary embodiment of FIG. 1 and the exemplary embodiment of FIG. 7 (showing an exemplary blank that may be used to form dispenser carton 100 of FIGS. 1 and 2 partially assembled for loading of articles therein), dispenser carton 100 is formed in accordance with this aspect of the present invention for loading along an end wall 110, 112 (in the illustrated embodiment, end wall 110). In the exemplary embodiment of FIG. 7, the loading equipment 400 used to load articles 101 in dispenser carton 100 loads articles 101 axially (i.e., pushes articles 101 into dispenser carton 100 so that articles 101 are moved along their longitudinal axes L). Moreover, dispensers 120, 130 preferably are oriented along walls that are substantially perpendicular to the end wall 110, 112 through which articles 101 are dispensed so that dispensers 120, 130 do not interfere with loading of articles 101. Preferably, dispensers 120, 130 are positioned so that articles 101 are oriented for optimal dispensing through at least one of dispenser openings 121, 131.

Figure 3:
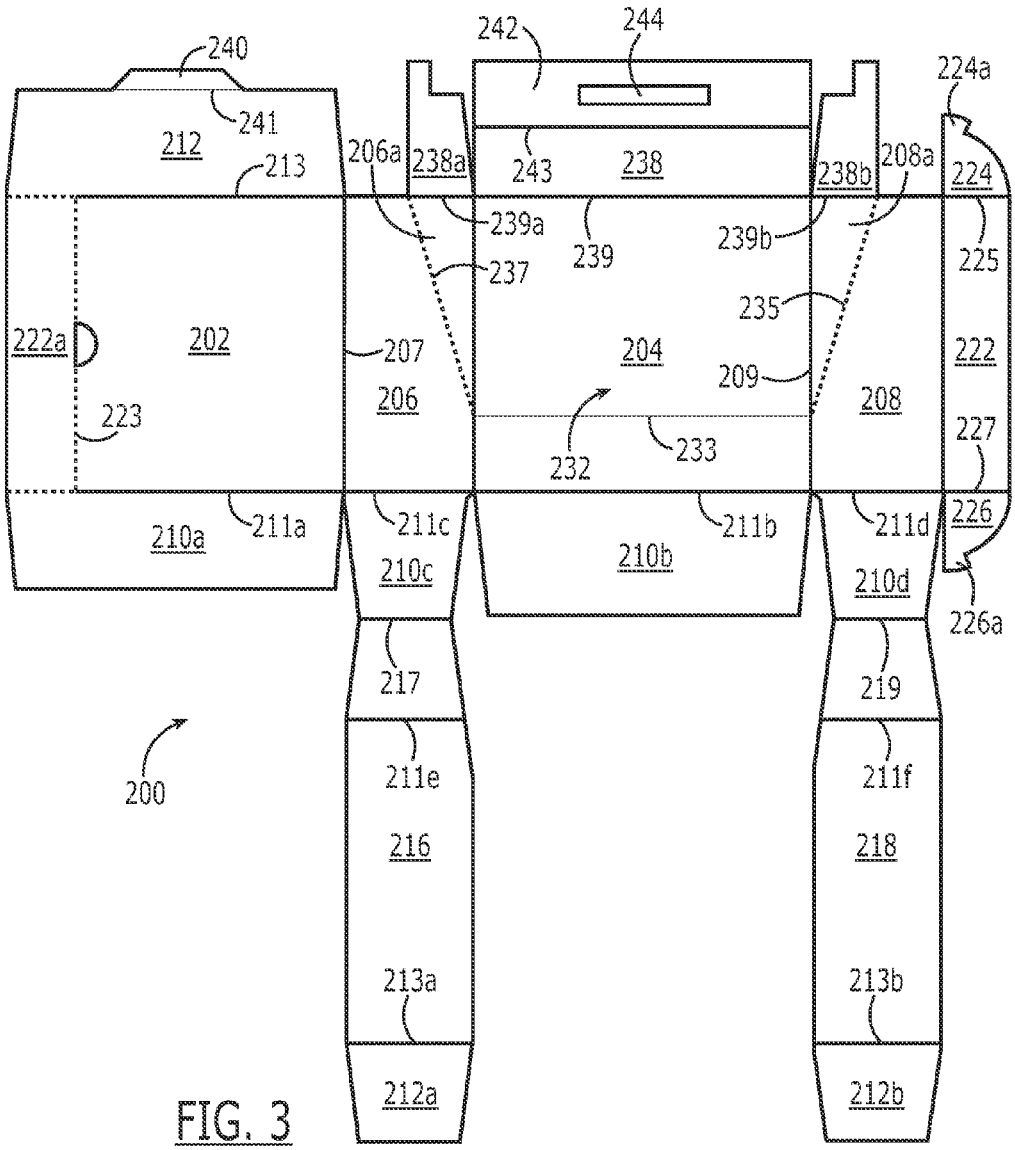
FIG. 3 is a plan view of a first embodiment of a carton blank from which a dispenser carton may be formed in accordance with principles of the present invention.
Figure 4:
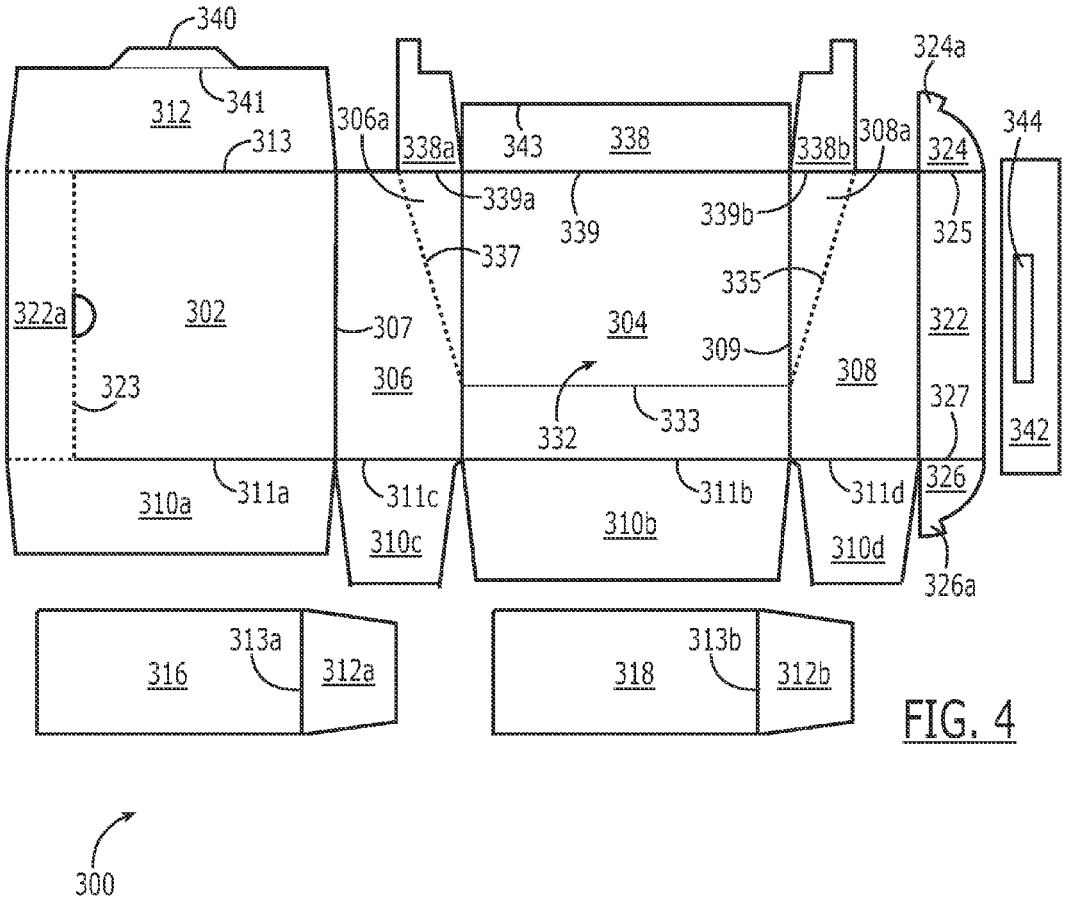
FIG. 4 is a plan view of a second embodiment of a carton blank and additional blank components from which a dispenser carton may be formed in accordance with principles of the present invention.

In the exemplary embodiment of FIGS. 1 and 2 (and as may be appreciated with reference to exemplary blank 200 of FIG. 3 and exemplary blank 300 of FIG. 4), dispenser 120, in the form of a dispenser door, is formed along one of major walls 102, 104 (specifically, major wall 102). In particular, dispenser door 120 is oriented with pivot axis or hinge 123 (hereinafter "hinge" for the sake of convenience, without intent to limit) substantially perpendicular to end wall 110, 112, so that longitudinal axes L of articles 101 are substantially aligned with hinge 123 for the desired sideways orientation within door 120 for optimal dispensing of articles 101 through dispenser opening 121. In addition, in the exemplary embodiment of FIGS. 1 and 2 (and as may be appreciated with reference to exemplary blank 200 of FIG. 7), dispenser 130, in the form of a flip-top lid, is formed along the other of major walls 102, 104 (specifically, major wall 104). In particular, lid dispenser 130 is oriented with pivot axis or hinge 133 (hereinafter "hinge" for the sake of convenience, without intent to limit) substantially parallel to end wall 110, 112, so that longitudinal axes L of articles 101 are substantially perpendicular to hinge 133 for the desired vertical orientation of articles 101 for optimal dispensing of articles 101 through lid dispenser 130 and dispenser opening 131. One manner of achieving the desired orientation of dispensers 120, 130 to permit optimal orientation of articles 101 for dispensing through either dispenser, as may be appreciated upon comparison of FIGS. 1 and 2, is to form dispenser door 120 to open about a hinge substantially parallel to a side wall of lid dispenser 130. Preferably, dispenser door 120 is formed along a wall that is not adjacent to the wall along which lid dispenser 130 is formed.

Figure 5:
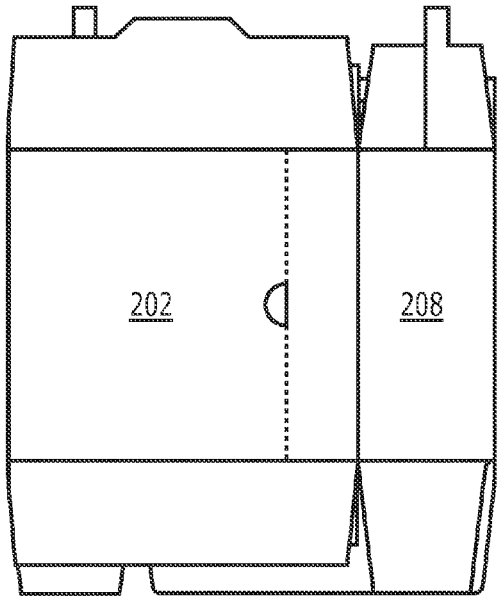
FIG. 5 is a plan view of one of the carton blanks of FIGS. 3 and 4 folded into a collapsed configuration to be popped open when the carton is to be filled with products.
Figure 6:
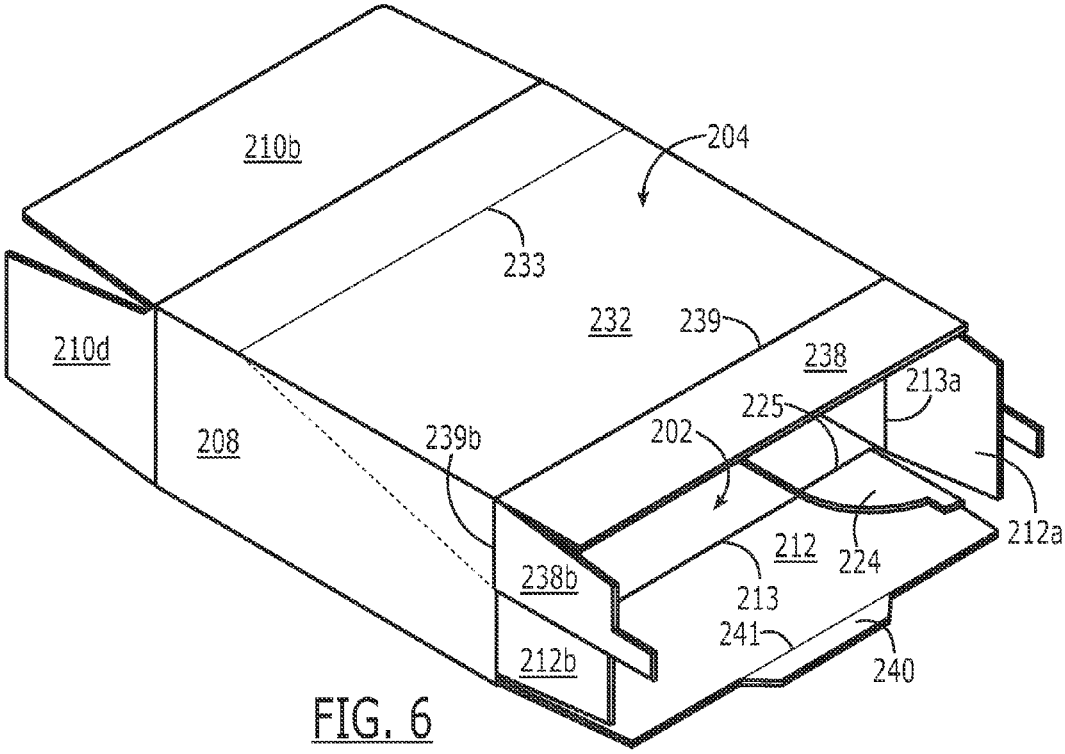
FIG. 6 is perspective view of the folded blank of FIG. 5 popped open for filling and folding into a closed configuration.
Figure 7:
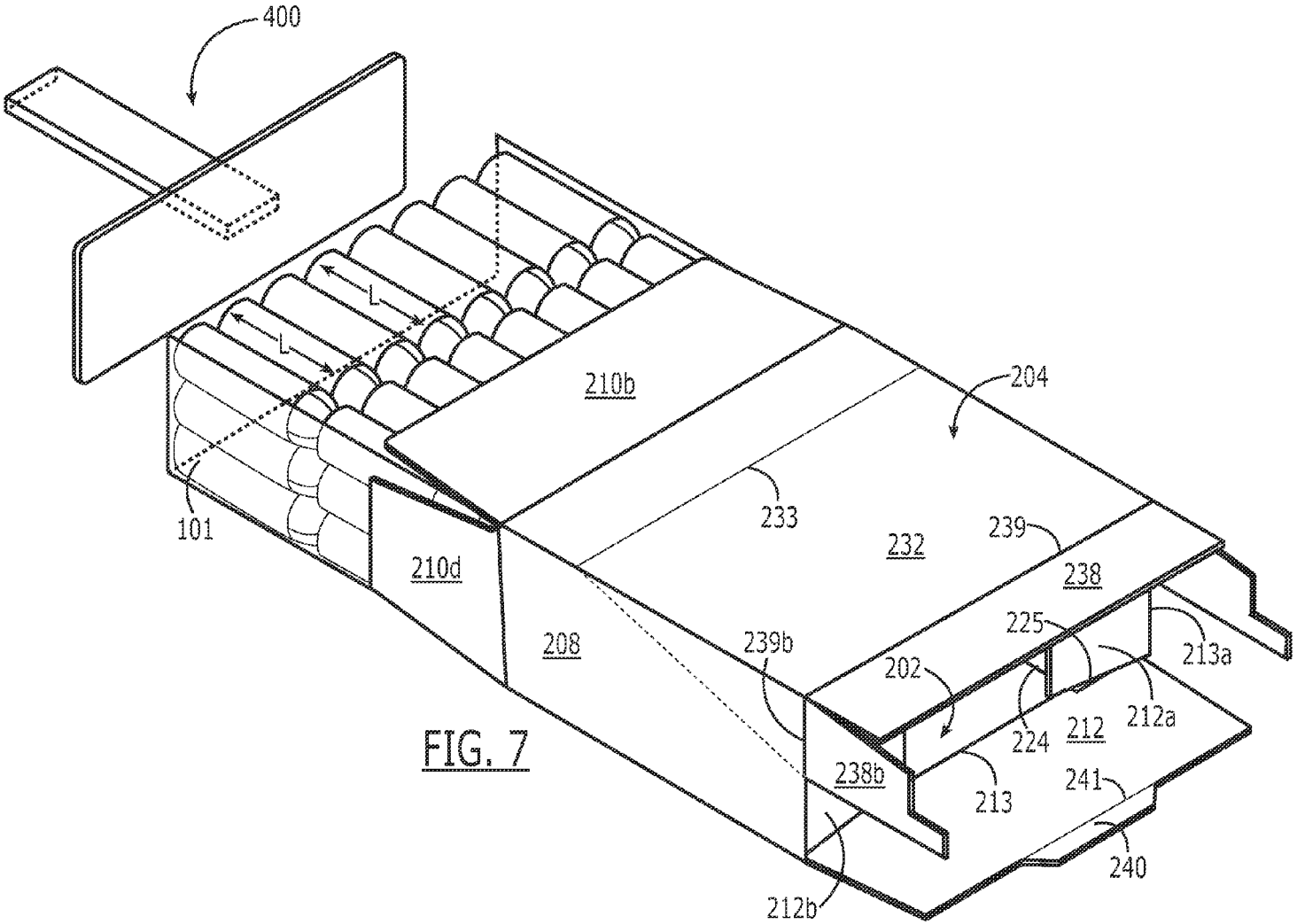
FIG. 7 is perspective view of the partially assembled carton of FIG. 6 being loaded with articles by schematically illustrated article-loading equipment.

As will be appreciated, it is desirable to form dispenser carton 100 in a manner that permits ready assembly thereof. More particularly, it is desirable to form carton 100 from a blank that is readily assembled into a carton 100 formed in accordance with one or both of the above aspects of the present invention. Exemplary blanks 200, 300 that are relatively easy to assemble into a dispenser carton formed in accordance with principles of the present invention and that are relatively easy to load with articles in accordance with principles of the present invention are illustrated in FIGS. 3-7. Exemplary blank 300 is similar to exemplary blank 200, except blank 200 is a single-piece blank while blank 300 is assembled from multiple blank components. Other than those differences, the features of blanks 200, 300 are substantially the same. Accordingly, although reference is made to blank 200 with regard to FIGS. 5-7, illustrating assembly of blank 200 into a carton, the descriptions of FIGS. 5-7 are substantially equally applicable to assembly of blank 300 into a carton. Generally, in the following description, elements or features of blank 300 similar to those of blank 200 are designated with the same reference numbers increased by 100 and redundant description is omitted.

Turning now to FIG. 3, exemplary blank 200 has a plurality of panels 202, 204, 206, 208, 210 (210*a* and 210*b* collectively referenced as 210), 212 which, upon folding of blank 200, form walls such as walls 102, 104, 106, 108, 110, 112 of exemplary carton 100 of FIGS. 1 and 2. Various fold lines and lines of weakening are provided to differentiate panels of blank 200 and to facilitate folding of blank 200 as well as formation of dispensers such as those described above. As used herein, the term "crease fold line" or "fold line" means an area of a structure that promotes or enhances bending, e.g., folding, without promoting separation, about the area. In an embodiment, a crease fold line may be half-cut, that is, the material may be cut halfway therethrough to aid in bending or creasing the material at the region of the cut. Alternately, in another embodiment the material may be scored to promote bending. As used herein, the term "line of weakness" means an area of material that promotes or enhances separation of a unitary or single structure into at least two structures. As such, a line of weakness can be made using mechanical means, including, but not limited to, embossing, scoring, or cutting; or non-mechanical means, including, but not limited to, chemical etching; lasers, heat; or combinations of mechanical and non-mechanical means. In one embodiment, a line of weakness is a line of alternating cuts and land areas, e.g., perforations. As used herein, the term "slit" means an area of material that is formed by a continuous cut. The material is separated completely from beginning of the line to the end of the line.

A portion of major wall panel 202 may be designated as dispenser panel 222*a*, which panel portion preferably is separable from major wall panel 202 along a line of weakness 223 to form at least a portion of a front wall of a dispenser such as the front wall 122 of dispenser 120 of exemplary carton 100, as described in further detail below. An additional panel, dispenser coupling panel 222 (typically referenced in the art as a "glue flap of a manufacturer's joint"—an additional panel generally associated with and overlapping one of the four major panels of a cuboid-type carton), may be provided for overlapping with dispenser panel 222*a* to form an inner panel of a wall such as front wall 122 of dispenser 120. Extending from each side of dispenser coupling panel 222 is a dispenser panel side segments 224, 226, which may respectively form a side wall 124, 126 of exemplary dispenser 120. A stop tab 224*a*, 226*a*, preferably extends from at least one of dispenser panel side segments 224, 226 to abut against an inner surface of the wall panel from which the dispenser door is extended (in the case of the embodiment of FIG. 1, to abut against major wall 102 upon assembly of blank 200 into a carton) to limit the extent of outward pivoting of the dispenser door formed by panels 222, 222*a*, 224, and 226. A portion of major wall panel 204 may be designated as dispenser front panel portion 232, which panel portion preferably is hingeably coupled to and distinct from the remainder of major wall panel 204 along a line of weakness 233 to form at least a portion of a wall of a dispenser such as the top wall 132 of lid dispenser 130 of exemplary carton 100, as described in further detail below.

Similarly, blank 300 (illustrated in FIG. 4) has a plurality of panels 302, 304, 306, 308, 310 (310*a* and 310*b* collectively referenced as 310), 312 which, upon folding of blank 300, form walls such as walls 102, 104, 106, 108, 110, 112 of exemplary carton 100 of FIGS. 1 and 2. Various fold lines and lines of weakening are provided, as in blank 200, to differentiate panels of blank 300 and to facilitate folding of blank 300 as well as formation of dispensers such as those described above. A portion of major wall panel 302 may be designated as dispenser panel 322*a*, which panel portion preferably is separable from major wall panel 302 along a line of weakness 323 to form at least a portion of a front wall of a dispenser such as the front wall 122 of dispenser 120 of exemplary carton 100, as described in further detail below. An additional dispenser coupling panel 322 (a "glue flap of a manufacturer's joint") may be provided for overlapping with dispenser panel 322*a* to form an inner panel of front wall 122 of dispenser 120. Extending from each side of dispenser coupling panel 322 is a dispenser panel side segment 324, 326, which may respectively form a side wall 124, 126 of dispenser 120. A stop tab 324*a*, 326*a*, preferably extends from at least one of dispenser panel side segments 324, 326 to abut against an inner surface of the wall panel from which the dispenser door is extended (in the case of the embodiment of FIG. 1, to abut against major wall 102 upon assembly of blank 200 into a carton) to limit the extent of outward pivoting of the dispenser door formed by panels 322, 322*a*, 324, and 326. A portion of major wall panel 304 may be designated as dispenser panel portion 332, which panel portion preferably is hingeably coupled to and distinct from the remainder of major wall panel 304 along a line of weakness 333 to form at least a portion of a wall of a dispenser such as the top wall 132 of lid dispenser 130 of exemplary carton 100, as described in further detail below.

As will be appreciated, an end wall such as end wall 110 of exemplary carton 100 may be formed from a single major flap or panel ("panel" herein, for the sake of convenience, without intent to limit), or from two major panels, such as end wall major panels 210*a*, 210*b* of blank 200, or end wall major panels 310*a*, 310*b* of blank 300, which pairs of panels preferably are overlapped to form a single wall. Panels 210*a*, 210*b*, 310*a*, 310*b* are referenced as "major" panels because minor flaps or panels 210*c*, 210*d*, and 310*c*, 310*d* may also be provided, over which major panels 210*a*, 210*b*, and 310*a*, 310*b*, respectively, may be overlapped and coupled. As used herein with respect to coupling of panels or flaps or other components of blanks to assemble a carton, "coupled" is to be understood as maintaining the components together, such as by adhering, such as with glue. It will be appreciated that one of the pairs of end wall major panels 210*a*, 210*b* and 310*a*, 310*b* may be slightly larger (in a direction extending away from the major wall panel 202, 204, 302, 304 from which the end wall major panel 210*a*, 210*b* and 310*a*, 310*b* extends) than the other of the pair. Preferably, the larger of the pair is overlapped over the smaller of the pair so that an end wall is thereby formed that extends substantially completely between major wall panels 102, 104. It will further be appreciated that, if desired, the panels forming end wall 110 may be configured so that end wall 110 may function as a third recloseable dispenser in the form of what is known in the art as a "cereal box closure." More particularly, end wall major panels 210*a*, 210*b* or end wall major panels 310*a*, 310*b* may be shaped to form a partial overlap seal (i.e., the panels overlap, yet neither panel extends the full distance between major wall panels 202, 204 or 302, 304 from which end wall major panels 210*a*, 210*b* and 310*a*, 310*b*, respectively, extend when blank 200/300 is assembled into a carton 100). Such panels may be separated to open carton 100 to access the contents thereof, and may be reclosed by inserting a tab formed on the free edge of one of the panels in a slit in the other of the panels to place the end wall major panels in a closed configuration.

An end wall such as end wall 112 of exemplary carton 100 may, similar to end wall 110, be formed from a single major flap or panel ("panel" herein, for the sake of convenience, without intent to limit), or from two panels, such as end wall major panel 212 and panel 238 of blank 200, or end wall major panel 312 and panel 338 of blank 300, which panels preferably are overlapped to form a single wall. It will be appreciated that end wall panels 238, 338 may be partial panels that are used to form a front end wall of a flip-top dispenser such as front end wall 138 of exemplary carton 100, as described in further detail below. Minor panels 238*a*, 238*b* may be folded under panel 238 to maintain panel 238 in position with respect to side wall panel sections 206*a* and

208*a* (sections of side wall panels 206, 208, respectively, to be separated therefrom to form a flip-top lid, as described in further detail below). Likewise, minor panels 338*a*, 338*b* may be folded under panel 338 to maintain panel 338 in position with respect to side wall panel sections 306*a* and 308*a* (sections of side wall panels 306, 308, respectively, to be separated therefrom to form a flip-top lid, as described in further detail below).

As will be appreciated with reference to FIG. 2, in an embodiment in which side wall panel sections 206*a*, 208*a* and 306*a*, 308*a* are separated along a line of weakness 237, 235, and 337, 335 from side wall panels 206, 208 and 306, 308, respectively, to remain coupled to and extending from dispenser front panel portion 232 to contribute to forming a flip-top lid, it may be desirable that the side walls formed by side wall panels 206, 208 and 306, 308 are not left as partial walls. Supplemental side wall panels 216, 218 and 316, 318 may be provided so that upon separation of side wall panel sections 206*a*, 208*a* and 306*a*, 308*a*, from side wall panels 206, 208 and 306, 308, respectively, supplemental side wall panels 216, 218 and 316, 318 provide complete (substantially rectangular) panels so that complete side walls (i.e., in the case of a dispenser carton such as carton 100, rectangular panels forming rectangular side walls) may be formed. In single-piece blank 200, supplemental side wall panels 216, 218 extend from and are folded over end wall minor panels 210*c*, 210*d* to overlap side wall panels 206, 208 as will be described in further detail below. In multiple component blank 300, side wall panels 316, 318 are separately formed panels which are overlapped over and coupled to side wall panels 306, 308 to complete side wall panels 306, 308. If desired, supplemental side wall panels 216, 218 may be coupled to side wall panels 206, 208 and, supplemental side wall panels 316, 318 may be coupled to side wall panels 306, 308. However, such attachment is not necessary and need not be effected. It will appreciated that preferably, supplemental side wall panels 216, 218 are not coupled to side wall panel sections 206*a* and 208*a*, respectively, and supplemental side wall panels 316, 318 are not coupled to side wall panel sections 306*a* and 308*a*, respectively, to permit a lid dispenser 130 to open readily without remaining coupled with supplemental side wall panels 216, 218 or 316, 318.

End wall major panels 212, 312 may also be overlapped over and coupled to end wall minor panels 212*a*, 212*b* and 312*a*, 312*b*, respectively (similar to end wall major panels 210, 310 and their respective end wall minor panels 210*c*, 210*d* and 310*c*, 310*d*). As may be appreciated with reference to the single-piece blank 200 of FIG. 1, end wall minor panels 212*a*, 212*b* are positioned for being overlapped by end wall major panel 212 upon folding of side wall panels 216, 218 to overlap side wall panels 206, 208. As may be appreciated with reference to the multiple component blank 300 of FIG. 2, upon overlapping of separately-formed side panels 316, 318 over side wall panels 306, 308, minor panels 312*a*, 312*b* are properly positioned for being folded and overlapped by end wall major panel 312. It will be appreciated that end wall panels 238, 338 also are preferably overlapped over end wall minor panels 212*a*, 212*b* and 312*a*, 312*b*. However, in the embodiment in which end wall panels 238, 338 form the front wall of a flip-top lid dispenser such as dispenser door 120, end wall panels 238, 338 are coupled only to minor panels 238*a*, 238*b*, and 338*a*, 338*b*, respectively, and not to end wall minor panels 212*a*, 212*b* and 312*a*, 312*b*.

As noted above, if a lid dispenser such as lid dispenser 130 is to be formed from blank 200 or blank 300, it may be desirable to provide a locking feature to hold the lid in a closed configuration. One such locking feature may be in the form of a protrusion, such as a tab, engaging in a detent, such as a slot. Such feature may be provided in exemplary blank 200 by locking tab 240, extending from end wall major panel 212, and slot 244, formed in locking panel 242 (which extends from and is folded to be overlapped with the interior surface of end wall panel 238). In multiple-piece exemplary blank 300, although a tab 340 may be readily formed as an extension of (and thus monolithically with) end wall major panel 312, slot 344 may optionally be provided in a separately formed locking panel 342 which may be coupled to end wall panel 338.

Turning now to FIGS. 3-7, the folding of exemplary blank 200 to form a carton with features formed in accordance with principles of the present invention will now be described. Although reference is not made to the manner of folding blank 300, it will be appreciated that references to elements of exemplary blank 200 are generally applicable to the corresponding features of exemplary blank 300 (the elements generally being referenced with the same reference numbers increased by 100, as noted above). As discussed and described herein, folding of adjoining walls along a fold line is preferably in a direction from the adjoining walls being at a substantially 180° angle with respect to each other (at least that portion of the blank being substantially flat) to a position in which the adjoining walls are at an angle (typically a 90 degree angle) with respect to each other. In other words, with reference to FIG. 3, the blank walls are folded in a direction out of the paper, the illustrated surface of blank 200 forming the interior surface of the carton to be formed therefrom (and the opposite, unillustrated surface forming the exterior surface of the carton).

As may be appreciated with reference to the above descriptions of the panels of exemplary blank 200, a preliminary step before folding blank 200 into an assembled dispenser carton is preferably to fold blank 200 along fold lines 217, 219 to place supplemental side wall panels 216, 218 in overlapped relation with side wall panels 206, 208 and to place minor panels 212*a*, 212*b* in position to be overlapped with end wall major panel 212. In addition, preferably locking panel 242 is folded with respect to panel 238 along fold line 243 to overlap with panel 238 to receive locking tab 240 upon assembly of blank 200. However, it will be appreciated that the folding of locking panel 242 along fold line 243 may be performed at a later time, prior to forming end wall 112 from panels 212 and 238. With regard to blank 300, the equivalent preliminary steps are to couple (a) separately formed side panels 316, 318 to side wall panels 306, 308 of blank 300 with minor panels 312*a*, 312*b* in position to be overlapped with end wall major panel 312; and (b) separately formed locking panel 342 with end wall panel 338 of blank 300 in a position overlapped therewith.

Because dispenser cartons are often formed from blanks that are formed in a first location, and are filled at a separate, second location, it is preferable that blanks formed in accordance with principles of the present invention may be folded into a flat initial configuration (either at the first location at which the blanks are formed, or at a separate location) that may be popped up for filling and final assembly. Thus, as illustrated in FIG. 5, the first step of folding blank 200 to form an assembled carton is to fold blank 200 along fold line 209 (between side wall panel 208 and major wall panel 204) and fold line 207 (between side wall panel 206 and major wall panel 202). The interior surface of dispenser panel 222*a* is coupled to the exterior surface of dispenser coupling panel 222. The resulting collapsed carton has major wall panel 202 substantially coplanar with side wall panel 208, and major wall panel 204 substantially coplanar with side wall panel 206, with panels 202 and 208 lying above panels 204 and 206. Such collapsed configuration facilitates shipping of multiples (e.g., cartons full of hundreds) of such collapsed, flat cartons for assembly into a carton at a different location. It will be appreciated that locking panel 242 preferably is folded along fold line 243 to lie against end wall panel 238 (with the interior surfaces of locking panel 242 and end wall panel 238 abutting each other) before above-described folding steps.

Assembly of a flattened collapsed carton as illustrated in FIG. 5 into a carton ready for filling is relatively simple. The upper and lower pairs of walls (in the case of the exemplary flattened collapsed carton of FIG. 5, walls 202, 208 and walls 204, 206) are shifted with respect to each other in a direction, for each pair, toward the shorter of the pair. Thus, in the exemplary embodiment of FIG. 5, walls 202, 208 are shifted in a direction toward wall 208, and walls 204, 206 are shifted in a direction towards wall 206. The flattened collapsed carton is then popped open into the configuration illustrated in FIG. 6.

As may be appreciated with reference to FIG. 6, filling of a carton formed from exemplary blank 200 or 300 is through one of the ends along which end wall major panel(s) 212 or 210 (e.g., 210*a* and 210*b*) are located. Preferably, articles are loaded into the carton through one of the ends, and the other end is at least partially closed to inhibit articles from inadvertently being pushed out of (or otherwise inadvertently exiting) the carton during loading. In the exemplary embodiment of FIGS. 5-7, articles are loaded through the end of the carton formed from blank 200 or 300 along which end wall major panels 210*a*, 210*b* are formed. Preferably, dispenser panel side segment 224 is folded inwardly (to be substantially perpendicular to dispenser coupling panel 222) along fold line 225 before end wall minor flap 212*b* is folded inwardly along fold line 213*b* over dispenser panel segment 224. As illustrated in FIG. 7, at least end wall minor panels 212*a*, 212*b* are folded inwardly along respective fold lines 213*a*, 213*b* (to be substantially perpendicular to side wall panels 206, 208, respectively) before the carton is filled with articles 101.

The remaining panels opposite the loading end of the carton may be folded into the fully assembled or closed configuration after articles 101 are loaded into the carton. In order to form a flip-top lid dispenser, end wall major panel 212 preferably is folded inwardly along fold line 213 (and preferably coupled to end wall minor panels 212*a*, 212*b*) before end wall minor panels 238*a*, 238*b* and end wall panel 238 are folded inwardly along fold lines 239*a*, 239*b*, and 239, respectively. In addition, locking tab 240 is folded outwardly along fold line 241 (under major end wall panel 212 as seen in FIG. 7) so that upon folding major end wall panel 212 into position to close the end of the carton (i.e., in a position substantially perpendicular to major wall panels 202 and 204), locking tab 240 protrudes away from the carton for locking engagement with the front wall of the flip-top lid dispenser formed upon folding end wall minor panels 238*a*, 238*b* inwardly and then folding end wall panel 238 over end wall minor panels 238*a*, 238*b* and coupling these panels together. Locking tab 240 thereby is positioned for locking in slot 244 (positioned along the interior side of end wall panel 238, not visible in FIG. 7).

Once articles 101 are fully loaded within the carton formed by blank 200 (or 300), the panels along the loading end of the carton preferably are folded to close the loading end and fully to assemble the blank into a closed carton configuration. Preferably dispenser panel side segment 226 first is folded inwardly along fold line 227 (to be substantially perpendicular to dispenser coupling panel 222) before end wall minor panels 210*c*, 210*d* are folded inwardly along respective fold lines 211*c*, 211*d* (into a position substantially perpendicular to side wall panels 206, 208, respectively). Preferably, supplemental side wall panel 216 includes a fold line 211*e*, corresponding to fold line 211*c*, so that supplemental side wall 206 can be folded about fold line 211*e* upon folding end wall minor panel 210*c* along fold line 211*c*. Likewise, supplemental side wall panel 218 preferably includes a fold line 211*f*, corresponding to fold line 211*d*, so that supplemental side wall 208 can be folded about fold line 211*f* upon folding end wall minor panel 210*c* along fold line 211*c*. Then, end wall major panels 210*a*, 210*b* are folded inwardly, along fold lines 211*a*, 211*b*, over end wall minor panels 210*c*, 210*d*, and preferably coupled thereto. If one of end wall major panels 210*a*, 210*b* is smaller than the other, the smaller of the two preferably is folded inwardly first, and the larger of the two is then folded over the smaller and coupled thereto. Blank 200 is thus fully assembled into a filled, closed carton.

To ready the assembled carton for dispensing articles 101, lines of weakness 223, 235, and 237 preferably are broken or otherwise severed to permit opening of dispensers formed by panels along such lines of weakness. In particular, line of weakness 223 may be broken to separate dispenser panel 222*a* from major wall panel 202 so that dispenser panel 222*a* and dispenser coupling panel 222 (coupled to the interior surface of dispenser panel 222*a*) may be pivoted away from major wall panel 202 into an open configuration such as shown in FIG. 1. Lines of weakness 235, 237 may be broken to separate side wall panel sections 206*a*, 208*a* from side wall panels 206, 208, respectively, thereby permitting a flip-top lid dispenser to be formed for pivoting upward away from major panel 204 and about line of weakness 233 (thus forming a hinge 133 for the lid dispenser) into an open configuration such as shown in FIG. 2.

It will be appreciated that the sequence of folding the various panels and tabs forming the end walls of the carton may be varied to at least some extent. For instance, the above-described folding of panels 212, 238, 238*a*, 238*b* may be performed after the folding of panels 210*a*, 210*b*, 210*c*, 210*d*. It will further be appreciated that the directional references "top," "bottom," "front," "back," "left," and "right" do not limit the respective panels to such orientation, but merely serve to distinguish these panels from one another. Finally, it will be appreciated features described with respect to one embodiment typically may be applied to another embodiment, whether or not explicitly indicated. The various features hereinafter described may be used singly or in any combination thereof. Therefore, the present invention is not limited to only the embodiments specifically described herein.

The exemplary embodiment illustrated in the figures has several separate and independent inventive features, which each, at least alone, has unique benefits which are desirable for, yet not critical to, the present invention. Therefore, the various separate features of the present invention need not all be present in order to achieve at least some of the desired characteristics and/or benefits of the present invention. One or more separate features may be combined, or only one of the various features need be present in a dispenser carton formed in accordance with the principles of the present invention. Moreover, throughout the present application, reference numbers are used to indicate a generic element or feature of the present invention. The same reference number may be used to indicate elements or features that are not identical in form, shape, structure, etc, yet which provide similar functions or benefits. Additional reference characters (such as letters, as opposed to numbers) may be used to differentiate similar elements or features from one another.

While the foregoing description and drawings represent exemplary embodiments of the present invention, it will be understood that various additions, modifications and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the invention being indicated by the appended claims, and not limited to the foregoing description.

In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A carton for containing and dispensing a plurality of articles within and from an interior of said carton, said carton comprising:

a first major wall;

a second major wall opposite said first major wall a first side wall extending between said first major wall and said second major wall;

a second side wall opposite said first side wall and extending between said first major wall and said second major wall;

a first end wall extending between said first major wall and said second major wall and between said first side wall and said second side wall;

a second end wall opposite said first end wall and extending between said first major wall and said second major wall and between said first side wall and said second side wall;

a first dispenser formed in said first major wall; and a second dispenser formed in said second major wall;

wherein:

said first dispenser is a dispenser door configured for pivoting, about a dispenser door hinge, between an open configuration and a closed configuration;

said second dispenser is a lid dispenser configured for pivoting, about a lid dispenser hinge, between an open configuration and a closed configuration;

said dispenser door hinge is substantially perpendicular to said lid dispenser hinge;

said lid dispenser has a top wall formed from a portion of first major wall, and a front wall along one of said first end wall and said second end wall;

said portion of said first major wall is coupled to a remainder of said first major wall along a hinge line extending substantially parallel to and spaced from said the other of said first end wall and said second end wall; and said lid dispenser has a first side wall formed from a portion of said first side wall of said carton, and a second side wall formed from a portion of said second side wall of said carton.

2. A carton as in claim 1, wherein upon opening said lid dispenser, said first side wall of said lid dispenser is separated from said first side wall of said carton leaving a partial first side wall of said carton, and said second side wall of said lid dispenser is separated from said second side wall of said carton leaving a partial second side wall of said carton, said carton further comprising:

a first supplemental side wall panel positioned along said first side wall of said carton such that upon opening said lid dispenser and moving said first side wall of said lid dispenser away from said first side wall of said carton, said first supplemental side wall completes said partial first side wall of said carton; and a second supplemental side wall panel positioned along said second side wall of said carton such that upon opening said lid dispenser and moving said second side wall of said lid dispenser away from said second side wall of said carton, said second supplemental side wall completes said partial second side wall of said carton.

3. A carton as in claim 1, wherein said dispenser door has a front wall formed by separating a dispenser panel portion of said first major wall from said first major wall along a line of weakness, and at least one side wall extending from a side edge of said dispenser door front wall.

4. A carton containing a plurality of elongated articles having a longitudinal axis, said carton comprising:

a first major wall;

a second major wall opposite said first major wall a first side wall extending between said first major wall and said second major wall;

a second side wall opposite said first side wall and extending between said first major wall and said second major wall;

a first end wall extending between said first major wall and said second major wall and between said first side wall and said second side wall;

a second end wall opposite said first end wall and extending between said first major wall and said second major wall and between said first side wall and said second side wall;

a first dispenser formed in one of said first major wall, said second major wall, said first side wall, said second side wall, said first end wall, and said second end wall; and a second dispenser formed in another of said first major wall, said second major wall, said first side wall, said second side wall, said first end wall, and said second end wall;

wherein:

said articles are all oriented in said carton to be oriented with respect to said first dispenser with said longitudinal axes thereof perpendicular to said first dispenser, and with respect to said second dispenser with said longitudinal axes parallel to said second dispenser;

said second dispenser is a lid dispenser having a top panel substantially coplanar with said second major wall and configured for pivoting about a lid dispenser hinge; and said articles are oriented for being dispensed from said second dispenser with said longitudinal axes of said articles extending substantially perpendicular to said second dispenser door hinge;

said lid dispenser top panel has a front edge, and a height in a direction from said front edge to said lid dispenser hinge;

said articles each have a height along said longitudinal axis thereof from a first end to a second end of said article;

said second major wall has a height in a direction substantially parallel to said lid dispenser height, said second major wall height being at least twice said article height;

said lid dispenser top panel height is longer than said article height and shorter than said height of said second major wall; and wherein at least two articles are arranged substantially collinearly and substantially perpendicular to said lid dispenser hinge.

5. A carton blank comprising:

a first panel having a left edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a second panel extending from said right edge of said first panel and having a left edge along said first panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a third panel extending from said right edge of said second panel and having a left edge along said second panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a fourth panel extending from said right edge of said third panel and having a left edge along said third panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a first top end panel extending from a top edge of one of said first, second, third, and fourth panels to close a top end of an open-ended carton formed upon folding said first, second, third, and fourth panels with respect to one another along said left and right edges thereof;

a first bottom end panel extending from a bottom edge of one of said first, second, third, and fourth panels to close a bottom end of an open-ended carton formed upon folding said first, second, third, and fourth panels with respect to one another along said left and right edges thereof;

a dispenser door score line defined in one of said first, second, third, and fourth panels to define a top edge of a dispenser door front panel upon being cut; and a flip-top lid fold line defined in an other of said first, second, third, and fourth panels to define a pivot hinge of a top panel of a flip-top lid defined by a portion of said other of said first, second, third, and fourth panels;

wherein said dispenser door score line is substantially parallel to the left edge and right edge of said panel in which said dispenser door score line is defined;

said flip-top fold line is substantially parallel to the top edge and bottom edge of said panel in which said flip-top lid fold line is defined; and said dispenser door score line is defined in said first panel and said flip-top lid fold line is defined in said third panel.

6. A blank as in claim 5, further comprising:

a first flip-top lid score line defined in said second panel to define a bottom edge of a first side wall of a flip-top lid upon cutting of said first flip-top lid score line; and a second flip-top lid score line defined in said fourth panel to define a bottom edge of a second side wall of a flip-top lid upon cutting said second flip-top lid score line.

7. A blank as in claim 6, further comprising a panel extending from said top edge of said second panel to form a front panel of a flip-top lid formed from said second panel.

8. A carton blank comprising:

a first panel having a left edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a second panel extending from said right edge of said first panel and having a left edge along said first panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a third panel extending from said right edge of said second panel and having a left edge along said second panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a fourth panel extending from said right edge of said third panel and having a left edge along said third panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a fifth panel extending from said right edge of said fourth panel and having a left edge along said fourth panel right edge, a right edge substantially parallel to and spaced apart from said left edge, a top edge extending between and substantially perpendicular to said left edge and said right edge, and a bottom edge substantially parallel to said top edge and extending between and substantially perpendicular to said left edge and said right edge;

a first top end panel extending from a top edge of one of said first, second, third, and fourth panels to close a top end of an open-ended carton formed upon folding said first, second, third, and fourth panels with respect to one another along said left and right edges thereof;

a first bottom end panel extending from a bottom edge of one of said first, second, third, and fourth panels to close a bottom end of an open-ended carton formed upon folding said first, second, third, and fourth panels with respect to one another along said left and right edges thereof;

a dispenser door score line defined in one of said first, second, third, and fourth panels to define a top edge of a dispenser door front panel upon being cut; and a flip-top lid fold line defined in an other of said first, second, third, and fourth panels to define a pivot hinge of a top panel of a flip-top lid defined by a portion of said other of said first, second, third, and fourth panels wherein:

said dispenser door score line is defined in said first panel; and said fifth panel is configured to overlap with a section of said first panel to form said dispenser door.

9. A blank as in claim 8, wherein said fifth panel further comprises a first dispenser panel side segment extending from said top edge of said fifth panel and a second dispenser panel side segment extending from said bottom edge of said fifth panel, said first dispenser panel side segment and said second dispenser panel side segment forming side walls of a dispenser door formed by said fifth panel and a portion of said first panel.

* * * * *